US008359672B2

(12) United States Patent
Moelker

(10) Patent No.: US 8,359,672 B2
(45) Date of Patent: Jan. 29, 2013

(54) HEADBAND WITH PIVOTAL PAD

(75) Inventor: Michael G. Moelker, Grandville, MI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 624 days.

(21) Appl. No.: 12/255,084

(22) Filed: Oct. 21, 2008

(65) Prior Publication Data

US 2010/0095438 A1 Apr. 22, 2010

(51) Int. Cl.
*A42B 1/22* (2006.01)

(52) U.S. Cl. ..... 2/418; 2/417; 2/420; 2/421; 2/183; 2/181

(58) Field of Classification Search ..... 2/8.1, 9, 2/181.4, 267, 420, 421, 468, 416, 455, 410, 2/414, 415, 418, 417; 128/201.22, 201.23, 128/201.24, 201.17; 24/68, 68 B, 71.1
See application file for complete search history.

(56) References Cited

U.S. PATENT DOCUMENTS

| | | | | |
|---|---|---|---|---|
| 2,205,742 | A | 6/1940 | Bower | |
| 3,214,809 | A | 11/1965 | Edwards | |
| 3,314,077 | A * | 4/1967 | Marchello | 2/421 |
| 3,591,863 | A * | 7/1971 | Rickard | 2/415 |
| 4,888,831 | A | 12/1989 | Oleson | |
| 5,373,588 | A | 12/1994 | Hede | |
| 5,421,799 | A * | 6/1995 | Rabin et al. | 601/71 |
| 5,704,072 | A | 1/1998 | Garneau | |
| 5,950,245 | A | 9/1999 | Binduga | |
| 6,332,227 | B1 | 12/2001 | Fang | |
| 6,341,382 | B1 | 1/2002 | Ryvin | |
| 6,708,376 | B1 | 3/2004 | Landry | |
| 7,000,262 | B2 * | 2/2006 | Bielefeld | 2/418 |
| 7,043,772 | B2 | 5/2006 | Bielefeld et al. | |
| 7,174,575 | B1 * | 2/2007 | Scherer | 2/418 |
| 7,222,374 | B2 | 5/2007 | Musal et al. | |
| 2005/0138719 | A1 * | 6/2005 | Huh | 2/416 |
| 2006/0070168 | A1 * | 4/2006 | Nakabayashi et al. | 2/171 |
| 2006/0195974 | A1 * | 9/2006 | Burkhart et al. | 2/421 |

* cited by examiner

*Primary Examiner* — Khoa Huynh
*Assistant Examiner* — Khaled Annis
(74) *Attorney, Agent, or Firm* — Dority & Manning, P.A.

(57) ABSTRACT

A headgear support that comprises a headband and a pad. The headband has a first end and a second end and forms a substantially closed perimeter having a length which is selectively adjustable. The pad is pivotally connected to the headband such that the pad is disposed within the substantially closed perimeter and pivots relative to the headband about a pivot axis.

18 Claims, 6 Drawing Sheets

HEADBAND WITH PIVOTAL PAD

BACKGROUND OF THE INVENTION

1. Field of the Invention

The present invention relates generally to devices for supporting a headgear, and more particularly, but not by way of limitation, to a headband with a pivotal pad.

2. Brief Description of Related Art

Protective headgear, for example construction hard hats, welding helmets, fire fighter helmets and the like, typically include headgear supports with headbands or head straps that are adjustable so that the headgear can be supported on any size head by the headband. The ability of a headgear to protect the head depends at least in part on the proper fitting of the helmet on a person's head. To accommodate different head sizes and head shapes of the general population, a headgear support typically has an adjustment mechanism, which includes adjustable straps that hold the helmet on the user's head and a head band that conforms to the circumference of the user's head. Although numerous adjustment mechanisms exist, the headband and/or the adjustment mechanisms do not tend to conform to the head of all users, particularly along the occipital region of the head, and thus can be uncomfortable to wear for an extended period of time.

To this end, a need exists for a headband that will readily conform to the head of a user. It is to such an apparatus that the present invention is directed.

DETAILED DESCRIPTION OF EXEMPLARY EMBODIMENTS

Figure 1:
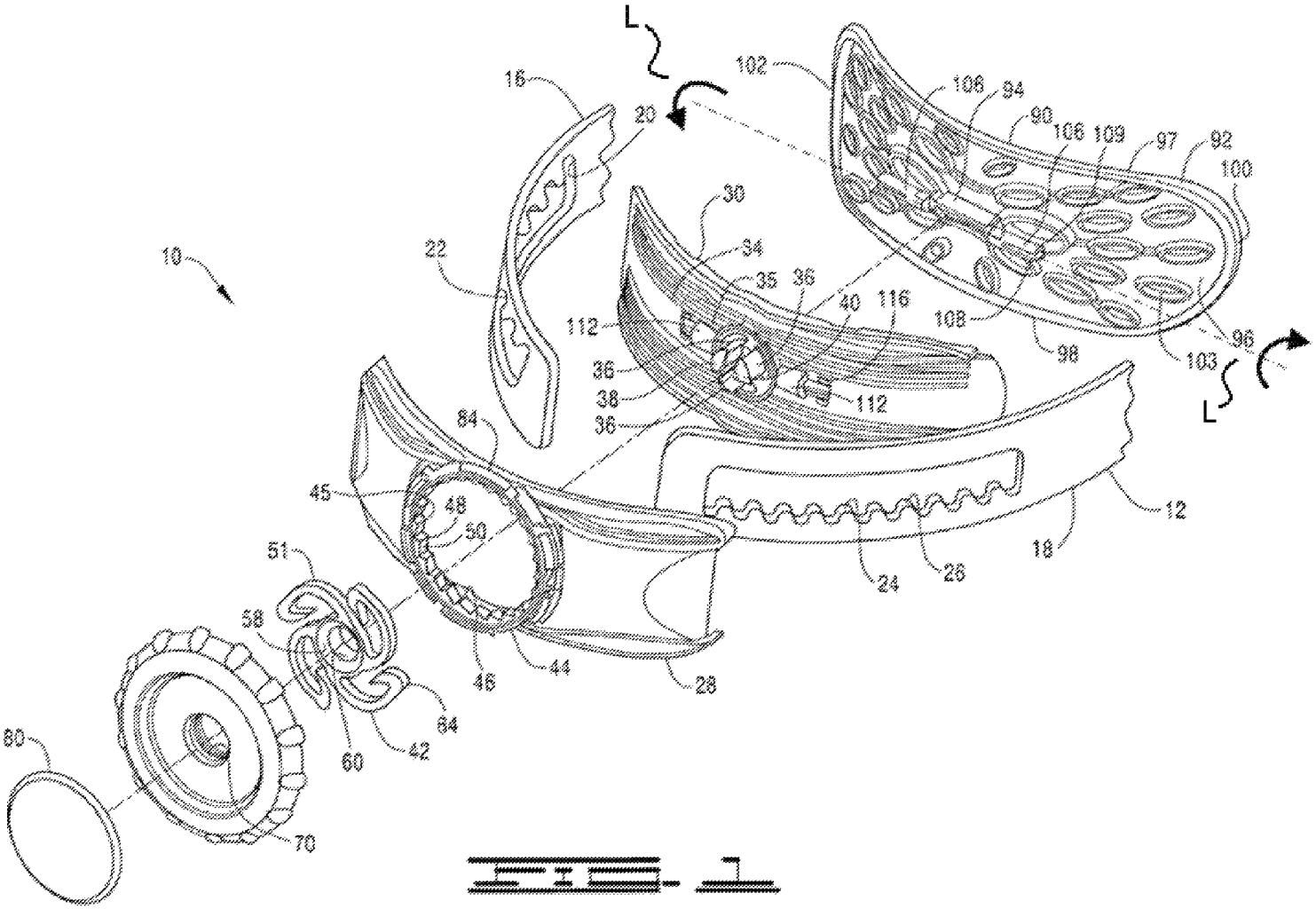
FIG. 1 is a rear exploded, perspective view of a headband adjustment apparatus constructed in accordance with the present invention, shown with a portion of a headband.

Referring now to the drawings, and more particularly to FIG. 1, an exploded view of a headband adjustment apparatus 10, a portion of a headband 12, and a pad 90 is shown. The headband 12 is connectable to a protective headgear, such as a welding helmet shell (not shown). However, it will be appreciated that the welding helmet shell is only one example of the type of protective headgear with which the headband adjustment apparatus 10 may be used. For example, the headband adjustment apparatus 10 may be used with construction hard hats, fire-fighter helmets, military helmets, and other types of headgear. In addition, the headgear need not necessarily be protective of the user's head.

The headband 12 includes a first strap portion 16 and a second strap portion 18. The first strap portion 16 is provided with an elongated slot 20, which is provided with a row of teeth 22 along one side thereof. Likewise, the second strap portion 18 is provided with an elongated slot 24 with a row of teeth 26 provided along one side thereof such that the teeth 22 of the first strap portion are positioned in a substantially opposing relationship with respect to the teeth 26 of the second strap portion 18 when the first strap portion 16 overlaps the second strap portion 18 with the elongated slot 20 generally aligned with the elongated slot 24.

Figure 2:
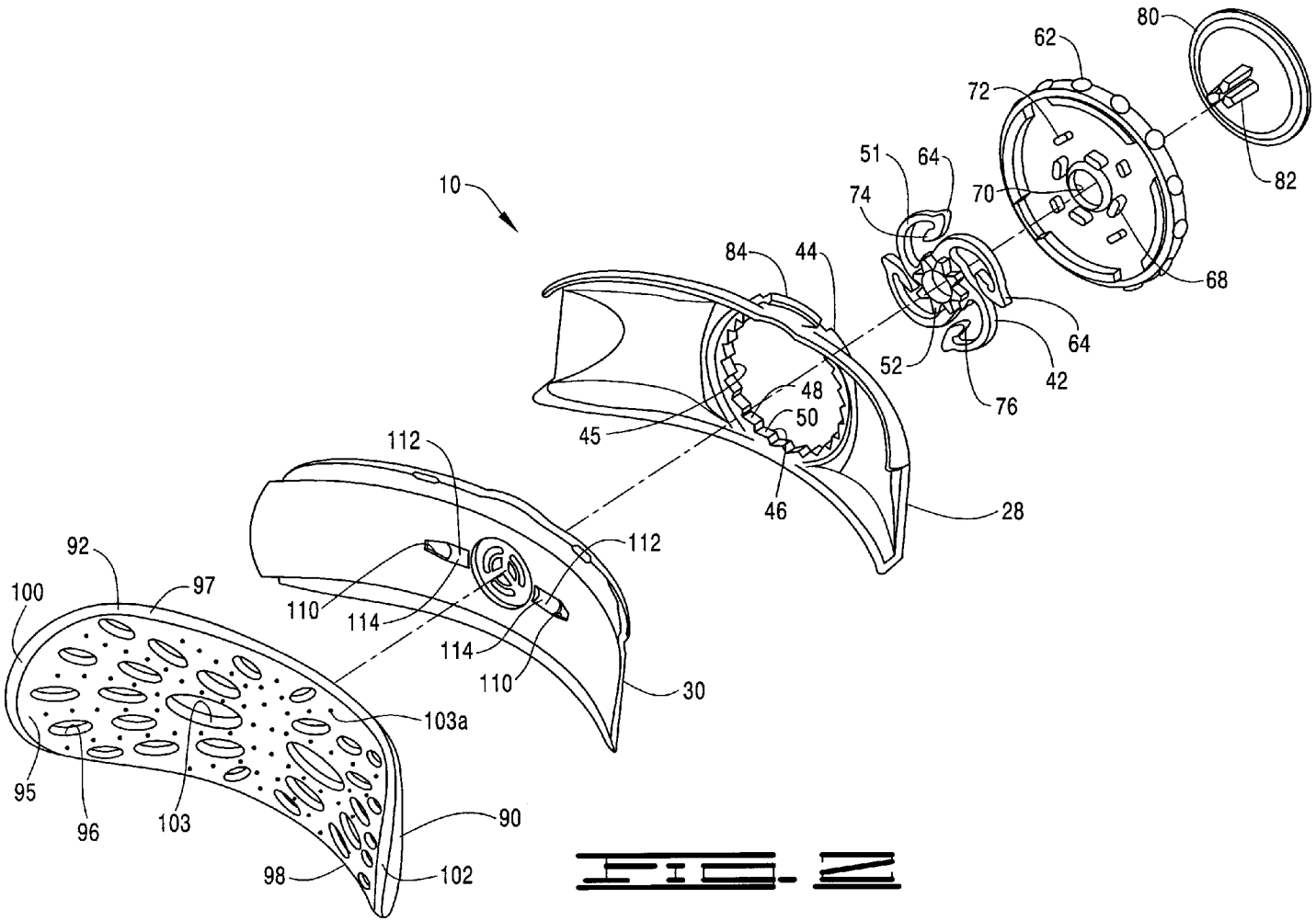
FIG. 2 is a rear exploded, perspective view of the headband adjustment apparatus.

Referring now to FIGS. 1 and 2, the headband adjustment apparatus 10 is designed to engage the teeth 22 and 26 so as to cause the first strap portion 16 and the second strap portion 18 to be moved relative to one another. The headband adjustment apparatus 10 includes an outer sleeve portion 28 and an inner sleeve portion 30 which cooperates with one another to form a sleeve for housing the first strap portion 16 and the second strap portion 18. The outer sleeve portion 28 and the inner sleeve portion 30 are generally arc shaped so as to conform to the contour of the back of a user's head. The inner sleeve portion 30 includes a plurality of longitudinal ribs or ridges 34 for facilitating sliding movement of one of the first strap portion 16 or the second strap portion 18. The ribs 34 are formed to have a flatted region 35 along the apex of the inner sleeve portion 30. The inner sleeve portion 30 further includes a plurality of tabs 36 extending outwardly from a central location of the inner sleeve portion 30. The tabs 36 spaced from one another so as to be inwardly flexible and to define a central opening 38. Each tab 36 is provided with a catch 40 for engagement with a ratchet gear 42.

The outer sleeve portion 28 is adapted to snap onto the inner sleeve portion 30 with the first strap portion 16 and the second strap portion 18 positioned between the outer sleeve portion 28 and the inner sleeve portion 30. The outer sleeve portion 28 includes a ratchet wheel 44 formed on an outer side thereof. The ratchet wheel 44 defines an opening 45 and is provided with a plurality of teeth 46 formed along an inner surface thereof. Each of the teeth 46 has a tapered surface 48 and a locking surface 50.

Figure 3:
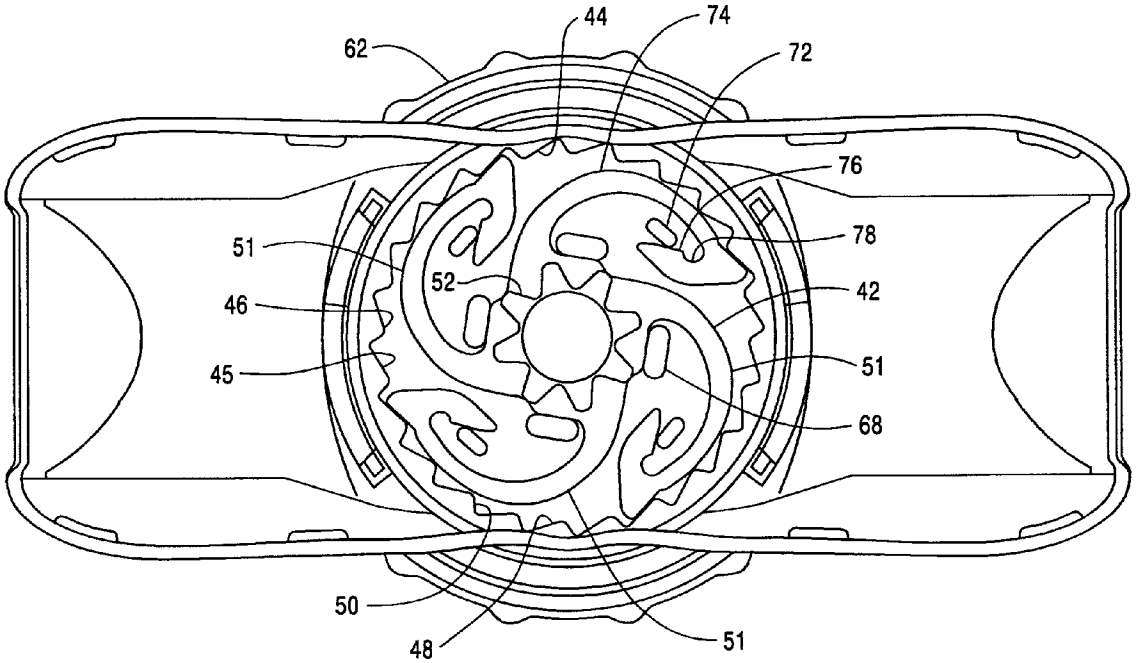
FIG. 3 is a front elevational view of an outer sleeve portion with a ratchet gear shown in an expanded position.
Figure 4:
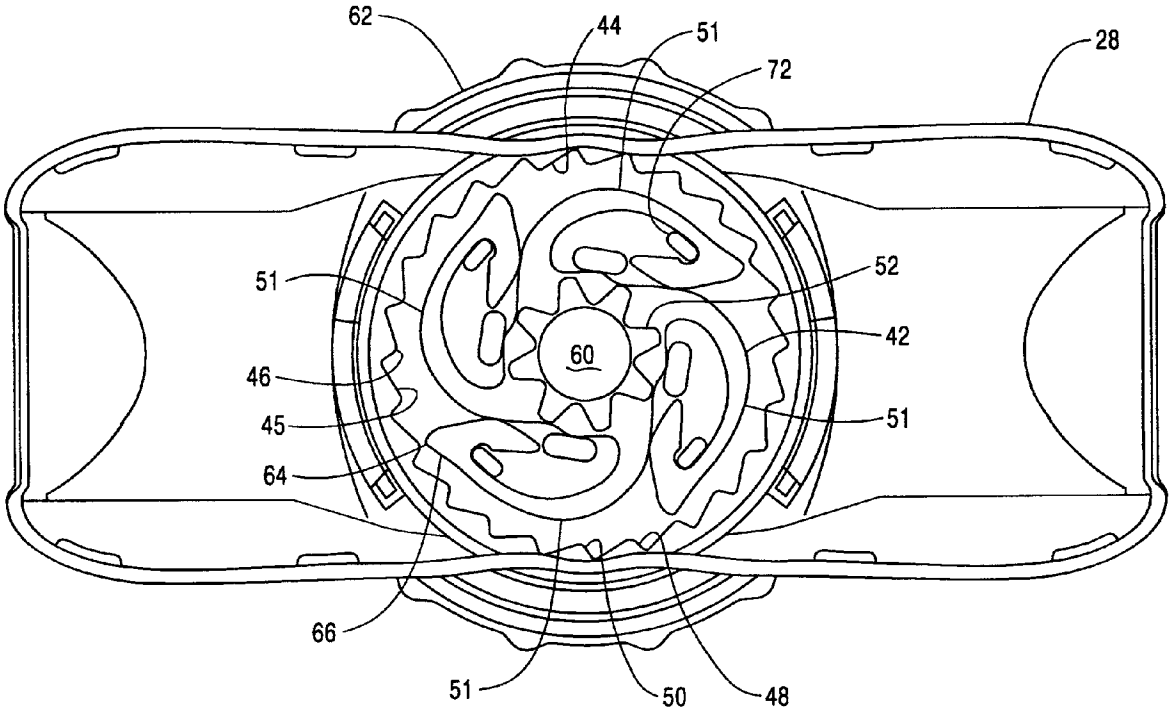
FIG. 4 is a front elevational view of the outer sleeve portion with the ratchet gear shown in a retracted position.

As shown in FIGS. 3 and 4, the ratchet gear 42 is positioned in the opening 45 of the ratchet wheel 44. The ratchet gear 42 includes a plurality of arms 51 and a pinion 52. The pinion 52 is adapted to engage the teeth 22 and 26 of the first strap portion 16 and the second strap portion 18, respectively. Each of the arms 51 extend from a hub 58. The hub 58 is provided with a central bore 60 which is adapted to receive the tabs 36 of the inner sleeve portion 30 whereby the catches 40 of the tabs 36 engage the hub 58 to secure the ratchet gear 42 to the sleeve formed by the outer sleeve portion 28 and the inner sleeve portion 30. The ratchet gear 42 is rotated by a knob 62 so as to cause the pinion 52 to move the first strap portion 16 and the second strap portion 18 relative to one another.

As shown in FIG. 3, the arms 51 are intended to engage the locking surface 50 of the teeth 46 so as to prevent the first strap portion 16 and the second strap portion 18 from moving in a direction that enlarges a loop formed by the first strap portion 16 and the second strap portion 18. In addition, the arms 51 are able to move over the tapered surfaces 48 of the ratchet wheel 44 when the ratchet gear 42 is rotated in a clockwise direction. Moreover, as shown in FIG. 4, the arms 51 are designed to be retracted so that the pinion 52 may be rotated in a counterclockwise direction to loosen the headband 12.

More specifically, the arms 51 of the ratchet gear 42 each extend from the hub 58 in a counterclockwise spiral. Each arm 51 has a pawl 64 which is positionable between adjacent teeth 26 of the ratchet wheel 44. A sliding surface 66 is configured to be substantially parallel to the tapered surface 48 of the teeth 46 to permit the pawl 64 to travel over the tapered surface 48 of the teeth 46 when the ratchet gear 42 is moved in a clockwise direction. In contrast, the pawl 64 is configured to engage the locking surface 50 of the teeth 46 in a substantially perpendicular relationship when the ratchet gear 42 is rotated in a counterclockwise direction thereby preventing counterclockwise rotation of the ratchet gear 42 when the arms 56 are in a retracted position with the pawls 64 positioned between adjacent teeth 46.

To rotate the ratchet gear 42 in a clockwise direction, so that the pinion 52 causes a first strap portion 16 and the second strap portion 18 to move toward one another, the knob 62 is provided with a plurality of bosses 68 on the inner surface thereof. The bosses 68 are equally spaced about a central opening 70. As shown in FIG. 4, the bosses 68 engage a lower end of the arms 51 in such a manner that causes the ratchet gear 42 to be rotated in a clockwise direction when the knob 62 is rotated in a clockwise direction. Furthermore, by positioning the bosses 68 at the lower end of the arms 51, the flexibility of the arms 51 is maintained whereby the arms 51 may freely travel over the teeth 48 when the ratchet gear 42 is rotated in a clockwise direction. The knob 62 is rotated in a clockwise direction until the headband 12 has been adjusted to the desired size. As shown in FIG. 4, the pawl 64 of each arm 56 is equally spaced so that the pawls 64 each engage the locking surface 50 of the teeth 46 simultaneously.

Figure 5:
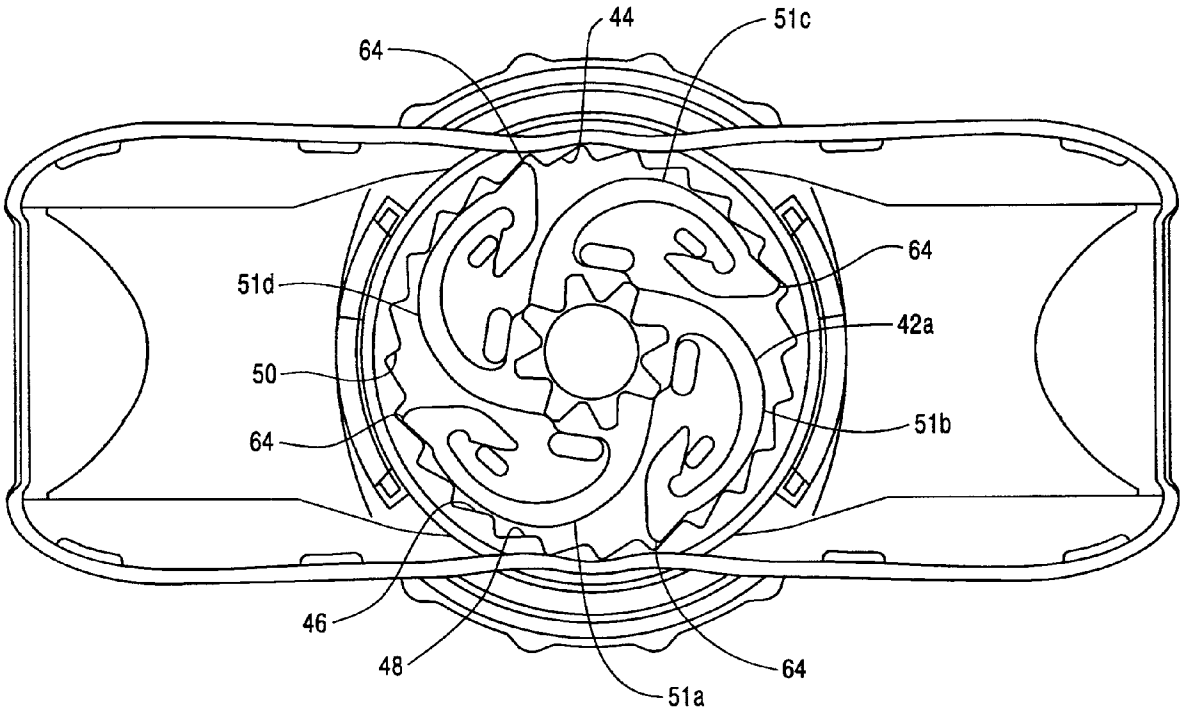
FIG. 5 is a front elevational view of the outer sleeve portion with another embodiment of a ratchet gear shown in an expanded position.

Referring now to FIG. 5, another embodiment of a ratchet gear 42*a* is shown positioned in the ratchet wheel 44. The ratchet gear 42*a* has a plurality of arms 51*a*-51*d*. The arms 51*a*-56*d* are spaced apart from one another such that when the pawls 64 of the arms 51*a* and 51*c* are engaged with the locking surfaces 50 of the teeth 46, the pawls 64 of the arms 51*b* and 51*d* are positioned on the tapered surfaces 48. By spacing the arms 51*a*-56*d* in this manner, the adjustment increment is decreased. As such, finer adjustments to the size of the headband 12 are permitted.

To move the arms 51 to a retracted position, and thus permit the ratchet gear 42 to be rotated in a counterclockwise direction to move the first strap portion 16 and the second strap portion 18 generally in a direction away from each other, the inner surface of the knob 62 is provided with a plurality of cams 72. The cams 72 are positioned to interact with a hook portion 74 of the arms 51. More specifically, the hook portion 74 has a cam surface 76 and a recess 78 for receiving the cam 72. Upon rotation of the knob 62 in a counterclockwise direction, each cam 72 engages the cam surface 76 of a corresponding arm 56. As the knob 62 continues to rotate in the counterclockwise direction, the engagement of the cam surface 76 with the cam 72 causes the arm 56 to move in an inward direction (FIG. 4) so as to retract the pawl 64 and disengage the pawl 64 from the teeth 46. Further rotation of the knob 64 causes the cam 72 to be lockingly received in the recess 78. With the arms 51 in the retracted condition, the ratchet gear 42 may be freely rotated in the counterclockwise direction so as to cause the first strap portion 16 and the second strap portion 18 to be moved generally away from each other to increase the size of the headband 12. Upon rotation of the knob 62 in the clockwise direction, the cams 72 are released from the recesses 78 thereby allowing the knob 68 to rotate relative to the ratchet gear 42 until the bosses 68 engage the lower end of the arms 51. With the cams 72 released from the recesses 78, the arms 51 return to the extended condition whereby the pawls 64 engage the teeth 46.

To prevent the tabs 36 of the inner sleeve portion 30 from moving inwardly and thereby releasing the ratchet gear 42, a cap 80, provided with a plurality of prongs 82 (FIG. 2), is positioned over the knob 62 with the prongs 82 disposed in the opening formed by the tabs 36. As such, the cap 80 is held stationary relative to the knob 62 whereby the outer surface of the cap 80 may be utilized to display a trademark, a logo, or other informational indicia in such a manner that the indicia does not rotate with rotation of the knob 62.

The knob 62 is rotatably connected to the ratchet wheel 44 via a plurality of flanges 84 extending radially from the ratchet wheel 44. To facilitate turning of the knob 62, the knob 62 is coated with a gripping material such as a rubber.

In the welding helmet application, in particular, the point of connection between the shell and the headgear is important because a welder will typically "nod" his helmet down in protective position with a sharp sudden movement of his head. With this "nodding" movement, the connection point provides a point of pivot for the protective shell which is independent of any headgear size adjustment. A drawback of the pivot connection between the headgear and the shell is that continuous movement will have a tendency to loosen the pivot point. Additionally, the welding helmet may vary in weight as the user adds, deletes, or changes filters or otherwise modifies his helmet configuration. Thus, a proper "nodding" movement will not be achieved should the weight of the shell be changed. Therefore, it is desirable to provide a pivot connection that allows the user to readily adjust the frictional engagement between the shell and the headgear to accommodate such changes in weight and personal preference.

Figure 6:
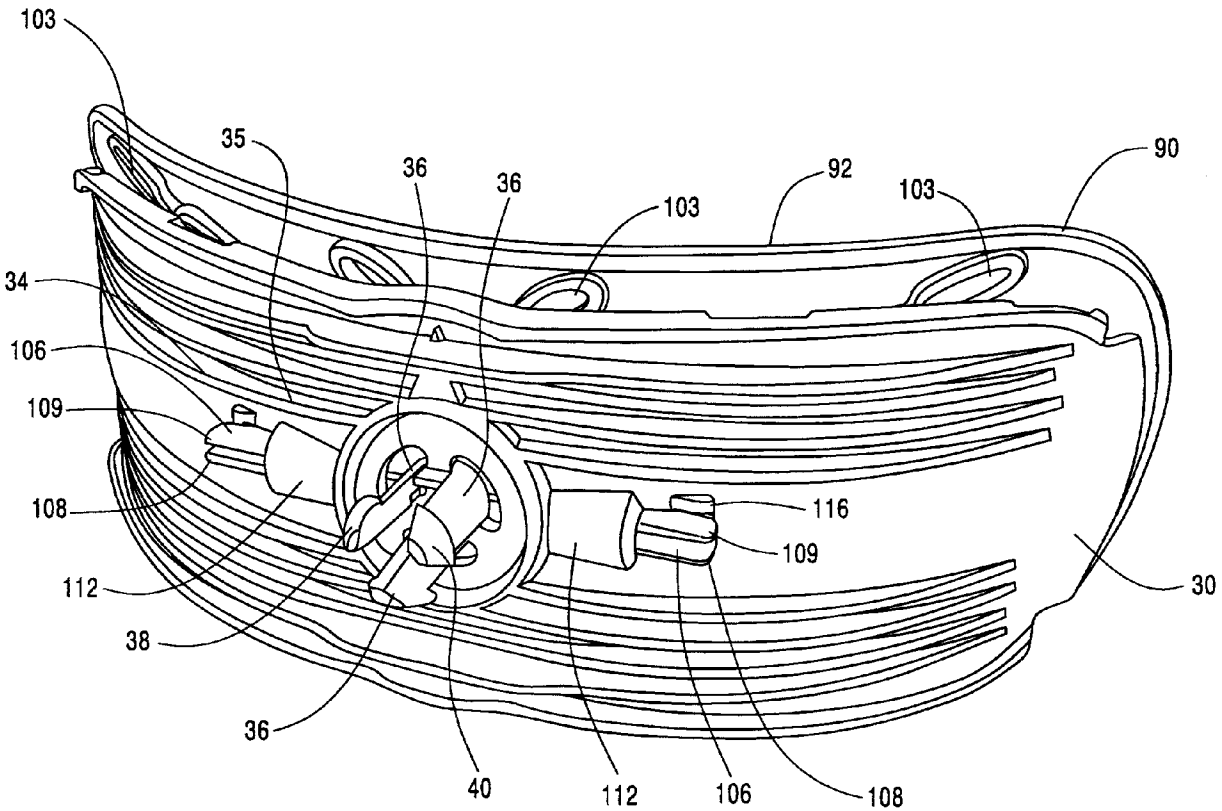
FIG. 6 is a rear perspective view of a pad shown pivotally connected to an inner sleeve of the headband adjustment apparatus.

Referring now to FIGS. 1, 2, and 6, the pad 90 serves to increase the comfort to the user when the headband 12 is positioned on the user's head by providing a member that readily conforms to contour of the user's head. The pad 90 is shown to be pivotally connected to the inner sleeve portion 30 of the adjustment mechanism 10. However, it should be appreciated that the pad 90 is not limited to being used with the adjustment mechanism 10, but may be connected to a variety of adjustment mechanisms or directly to a headband.

The pad 90 includes a pad portion 92 and an extension portion 94. The pad portion 92 has a front side 95, a rear side 96, an upper side 97, a lower side 98, a first lateral side 100, and a second lateral side 102. The pad portion 92 is preferably elongated and provided with an arcuate, curved, or otherwise contoured shape so as to at least partially correspond to the shape of a user's head and/or neck. In one embodiment, the front and rear sides 95 and 96 of the pad portion 92 are shaped to correspond to one another, as shown. In other embodiments, the front and rear sides 95 and 96 may be provided with different shapes. For example, the front side 95 may be contoured to at least partially correspond to the shape of a user's head and/or neck, and the rear side 96 may be provided with a substantially flat shape, such as to facilitate or reduce the cost of manufacturing the pad 90. In yet further embodiments, the pad portion 92 may be provided with any suitable shape or size.

The pad portion 92 may be provided with a plurality of openings or perforations 103 extending between the front and rear sides 95 and 96 so as to promote air circulation through the pad portion 92 to the user's head. In this way, the pad portion 92 "breathes" so as to reduce moisture accumulation between the pad portion 92 and the user's head and/or neck, and thereby increase comfort to the user. Additionally, the openings 103 may help reduce slippage or sliding of the pad portion 92 relative to the user's head and/or neck. To further prevent slippage, the pad portion 92 may be provided with a textured surface elements 103*a*. The textured surface elements 103*a* are illustrated in FIG. 2 as being a plurality of bumps formed on the front side 95 of the pad portion 92. The bumps may vary in size and shape, but it is preferred that the textured surface elements 103*a* be sized and shaped to provide a gripping function. To this end, it will be appreciated that the textured surface elements may be in the form of a wide variety of elements, such as ridges or a knurled surface.

As shown in FIG. 1, the extension portion 94 extends from the rear side 96 of the pad portion 92, as shown. The extension portion 94 preferably supports a pair of posts 106 a distance from the rear surface 96 of the pad portion 92 so as to provide an axis about which the pad 90 is able to pivot. In the preferred embodiment, the posts 106 are preferably integrally formed with the extension portion 94. In other embodiments, the posts 106 may be formed by a single rod cooperating with the extension portion 94, for example, a single rod could be pressed, threaded, or glued into an aperture in the extension portion 94 so as to extend from both sides of the extension portion 94 to provide the pair of posts 106 extending from the extension portion 94. In yet further embodiments, the posts 106 and the extension portion 104 may be formed or constructed in any suitable configuration that permits the pad 90 to function as described herein.

In the embodiment shown, the ends of the posts 106 are provided with notches such that the posts 106 are characterized as having a pair of tines 108 and 109 which are inwardly flexible. The end of each of the tines 108 and 109 is preferably tapered on a side away from the pad 90 to facilitate connection with the inner sleeve portion 30 of the headband adjustment apparatus 10 in a manner to be discussed below.

The inner sleeve portion 30 is provided with a pair of openings 110 (FIG. 2). Each opening 110 is adapted to receive one of the posts 106 of the pad 90. To support the posts 106, the inner sleeve 30 is provided with a pair of bearing portions 112. Each bearing portion 112 has a semi-circular profile and defines a bearing surface 114 (FIG. 2) that is generally oriented along a tangent of the inner sleeve 30 and against which at least a portion of the posts 106 may rotate. An outer portion of the openings 110 is tapered inwardly to define a retaining wall 116 (FIG. 1) against which the tines 108 and 109 of the posts 106 contact when positioned through the openings 110. The inward flexibility of the tines 108 and 109 permits the tines 108 and 109 to move past the retaining wall 116 when connecting the pad 90 to the inner sleeve 30 or disconnecting the pad 90 from the inner sleeve 30 should it be desired to use the headband 12 without the pad 90. In the preferred embodiment, the posts 106 are received in the openings 110 to permit the pad 90 to rotate relative to the inner sleeve portion 30 about the rotational or longitudinal axis L of the posts 106. The extension portion 104 preferably maintains an offset or spaced-apart relationship between the pad portion 92 and the inner sleeve portion 30 so as to further enable rotational movement therebetween and about the axis of the posts 106.

The range of rotational motion is generally limited by the distance between the rear side 96 of the pad portion 92 and the inner sleeve portion 30. For example, a greater distance therebetween will permit a greater degree of rotation, while a smaller distance therebetween will permit a smaller degree of rotation. In some embodiments, it is desirable to apply this principle to limit the degree of rotation between the pad portion 92 and the inner sleeve portion 30. In one such embodiment, the total sweep of rotation of the pad 90 relative to the inner sleeve portion 30 is preferably limited to about 45 degrees. However, a greater range of motion may be preferred, or it may be desired to limit rotation more in one direction than the other direction by any suitable means, such as, for example, by providing protrusions or the like from either of the pad 90 and the inner sleeve portion 30 to limit the range of rotation therebetween. For instance, the pad may be permitted to rotate relative to a rotational or longitudinal pivot axis L of the adjustment assembly in an angular range of between about 5 degrees and about 45 degrees. In further embodiments, the pad 90 may be provided with one or more springs, shock absorbers, and/or resilient elements (not shown), such as, for example, to bias the rotation of the pivot pad 90 in a given direction, to increase comfort to a user by reducing shocks transmitted to the user by sudden rotations between the pad 90 and the inner sleeve portion 30, any combination thereof, and/or the like, Although the pad 90 is described in conjunction with the headband adjustment assembly 10, it should be understood that the principles, structure and function of the pad 90 described herein may be incorporated with any type of headband, headgear, helmets, hats, hard hats, or the like so as to improve fit, function, comfort, or the like. It should be further understood that the element that forms the axis of pivot for the pad 90 may be connected to, or formed as a part of, the adjustment assembly or the headband, rather than be a part of the pad 90 as has been described in detail above, and the pad 90 may be formed to receive the element that forms the axis of pivot.

From the above description, it is clear that the present invention is well adapted to carry out the objects and to attain the advantages mentioned herein, as well as those inherent in the invention. While a presently preferred embodiments of the invention have been described for purposes of this disclosure, it will be understood that numerous changes may be made which will readily suggest themselves to those skilled in the art and which are accomplished within the spirit of the invention disclosed and described in the appended claims.

What is claimed is:

1. A headgear support, comprising:

a headband having a first end and a second end;

an adjustment assembly through which the first and second ends of the headband are disposed such that the headband forms a substantially closed perimeter having a length selectively adjustable by relative movement of the first and second ends of the headband through the adjustment assembly;

a pad pivotally connected to the adjustment assembly such that the pad is disposed within the substantially closed perimeter and pivots, at least in a substantially vertical direction, relative to the adjustment assembly about a longitudinal pivot axis, and wherein the pad's relative position to the adjustment assembly and the headband is unaffected by adjustment of the headband by the adjustment assembly;

the pad has a pad portion having a front side and a rear side and an extension portion extending from the rear side and supporting the pad portion in a spaced-apart relationship relative to the headband, such that the pad portion is distanced from the headband and only the front side of the pad portion contacts or faces toward a user;

wherein the pad is permitted to rotate relative to the longitudinal pivot axis in an angular range of between about 5 degrees and about 45 degrees;

wherein the pad further includes one or more posts operatively associated with the extension portion, and wherein the one or more posts are substantially co-linear with the longitudinal pivot axis;

wherein the adjustment assembly includes one or more openings sized to selectively receive the one or more posts of the pad such that the posts are substantially free to rotate in an angular range of between about 5 degrees and about 45 degrees within the one or more openings; and wherein the one or more posts includes two posts and wherein one of the two posts extends perpendicularly from one side of the extension portion and the other of the two posts extends perpendicularly from an opposite side of the extension portion such that the two posts are substantially co-linear with one another and also substantially co-linear with the longitudinal pivot axis.

2. The headgear support of claim 1, wherein the pad has a contoured shape so as to at least partially conform to the shape of the user's head or neck.

3. The headgear support of claim 1, wherein the adjustment assembly comprises a manually rotatable adjusting member, the pivot axis of the pad intersects a rotational axis of the manually rotatable adjusting member.

4. The headgear support of claim 1, wherein the pad is selectively removable from the adjustment assembly.

5. The headgear support assembly of claim 1, wherein the pad includes a textured surface.

6. The headgear support of claim 1, wherein the pad includes at least one post defining the pivot axis.

7. The headgear support of claim 1, wherein the pad has an arcuate pad portion.

8. The headgear support of claim 7, wherein the pad portion includes a plurality of openings extending from the front side to the rear side.

9. The headgear support of claim 1, wherein each of the posts includes a pair of flexible tines at a distal end thereof.

10. A headgear support, comprising:

a headband having a first end and a second end and forming a substantially closed perimeter having a length which is selectively adjustable; and a pad disposed within the substantially closed perimeter and pivotal, at least in a substantially vertical direction, relative to the headband about a fixed longitudinal pivot axis that remains stationary on the headgear support regardless of adjustment of the first and second ends of the headband;

the pad has a pad portion and an extension portion, the pad portion has a front side and a rear side, the extension portion extending from the rear side and supporting the pad portion in a spaced-apart relationship relative to the headband and only the front side of the pad portion contacts or faces toward a user;

wherein the pad is permitted to rotate relative to the longitudinal pivot axis in an angular range of between about 5 degrees and about 45 degrees;

wherein the pad further includes one or more posts operatively associated with the extension portion, and wherein the one or more posts are substantially co-linear with the longitudinal pivot axis;

wherein the headband includes one or more openings sized to selectively receive the one or more posts of the pad such that the posts are substantially free to rotate in an angular range of at least about five degrees within the one or more opening; and wherein the one or more posts includes two posts and wherein one of the two posts extends perpendicularly from one side of the extension portion and the other of the two posts extends perpendicularly from an opposite side of the extension portion such that the two posts are substantially co-linear with one another and also substantially co-linear with the longitudinal pivot axis.

11. The headgear support of claim 10, wherein the pad has a contoured shape so as to at least partially conform to the shape of the user's head or neck.

12. The headgear support of claim 10, wherein the pivot axis intersects at least a portion of the headband.

13. The headgear support of claim 10, wherein the pad is selectively removable from the headband.

14. The headgear support assembly of claim 10, wherein the pad includes a textured surface.

15. The headgear support of claim 10, wherein the pad includes at least one post defining the pivot axis.

16. The headgear support of claim 10, wherein the pad has an arcuate pad portion.

17. The headgear support of claim 16, wherein the pad portion includes a plurality of openings extending from the front side to the rear side.

18. The headgear support of claim 10, wherein each of the posts includes a pair of flexible tines at a distal end thereof.

* * * * *